US009086665B2

(12) United States Patent
Soeda

(10) Patent No.: US 9,086,665 B2
(45) Date of Patent: Jul. 21, 2015

(54) FIXATION APPARATUS AND IMAGE FORMATION APPARATUS

(71) Applicant: Oki Data Corporation, Tokyo (JP)

(72) Inventor: Teruo Soeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/038,801

(22) Filed: Sep. 27, 2013

(65) Prior Publication Data

US 2014/0093290 A1 Apr. 3, 2014

(30) Foreign Application Priority Data

Oct. 1, 2012 (JP) ..... 2012-218991

(51) Int. Cl.
*G03G 15/20* (2006.01)

(52) U.S. Cl.
CPC ..... *G03G 15/2078* (2013.01); *G03G 15/2039* (2013.01); *G03G 15/2053* (2013.01); *G03G 2215/2022* (2013.01)

(58) Field of Classification Search
CPC ..... G03G 15/2078
USPC ..... 399/320, 328, 329, 330, 331, 334
See application file for complete search history.

(56) References Cited

U.S. PATENT DOCUMENTS

| | | | | |
|---|---|---|---|---|
| 7,778,584 | B2 * | 8/2010 | Nishiyama et al. | 399/329 |
| 2013/0078018 | A1 * | 3/2013 | Yabuki | 399/329 |

FOREIGN PATENT DOCUMENTS

| | | | |
|---|---|---|---|
| JP | H05-127550 | A | 5/1993 |
| JP | H10-260599 | A | 9/1998 |
| JP | 2002-033177 | A | 1/2002 |
| JP | 2011-112687 | A | 6/2011 |
| JP | 2011-257455 | A | 12/2011 |
| JP | 2012-159543 | A | 8/2012 |

* cited by examiner

*Primary Examiner* — David Gray
*Assistant Examiner* — Michael Harrison
(74) *Attorney, Agent, or Firm* — Marvin A. Motsenbocker; Mots Law, PLLC

(57) ABSTRACT

A fixation apparatus for fixing a developer image to a recording medium includes: a fixation belt; a heater member configured to generate heat by a resistance heating element and heat the fixation belt; and a pressurization member provided at a position opposed to the fixation belt with the heater member interposed in between and configured to press the heater member against the fixation belt while being in contact with the heater member. The pressurization member includes a temperature adjustment part provided near an end portion in the longitudinal direction of the pressurization member and designed to control an amount of heat transmitted from the heater member.

15 Claims, 5 Drawing Sheets

FIXATION APPARATUS AND IMAGE FORMATION APPARATUS

CROSS REFERENCE TO RELATED APPLICATIONS

This application claims priority based on 35 USC 119 from prior Japanese Patent Application No. 2012-218991 filed on Oct. 1, 2012, entitled "FIXATION APPARATUS AND IMAGE FORMATION APPARATUS", the entire contents of which are incorporated herein by reference.

BACKGROUND OF THE INVENTION

Field of the Invention

The disclosure relates to a fixation apparatus and an image formation apparatus which uses the same, and especially relates to an apparatus which uses a fixation belt.

Conventionally, a fixation apparatus includes a heater member, and a heat transmission member which is in contact with the heater member and has a curved surface in contact with a fixation belt. In the fixation apparatus, the heat transmission member transmits heat of the heater member to the fixation belt to heat the fixation belt. The heated fixation belt fuses and fixes the developer on a printing medium being conveyed, by pressing the developer against the printing medium (for example, Patent Literature 1: Japanese Patent Application Publication No. 2011-257455 (see (pages 5-6, FIG. 1, FIG. 3)).

SUMMARY OF THE INVENTION

However, the image quality might be lowered in the above-mentioned conventional fixation apparatus.

An object of one embodiment of the invention is to improve the image quality.

An aspect of the invention is a fixation apparatus for fixing a developer image transferred onto a recording medium to the recording medium. The fixation apparatus includes: a fixation belt; a heater member configured to generate heat by a resistance heating element and heat the fixation belt; and a pressurization member provided on a position opposed to the fixation belt with the heater member interposed in between and configured to press the heater member against the fixation belt while being in contact with the heater member. The pressurization member includes a temperature adjustment part provided near an end portion in the longitudinal direction thereof and designed to suppress the amount of heat transmitted from the heater member.

According to the aspect, the image quality can be improved.

DETAILED DESCRIPTION OF EMBODIMENTS

Figure 1:
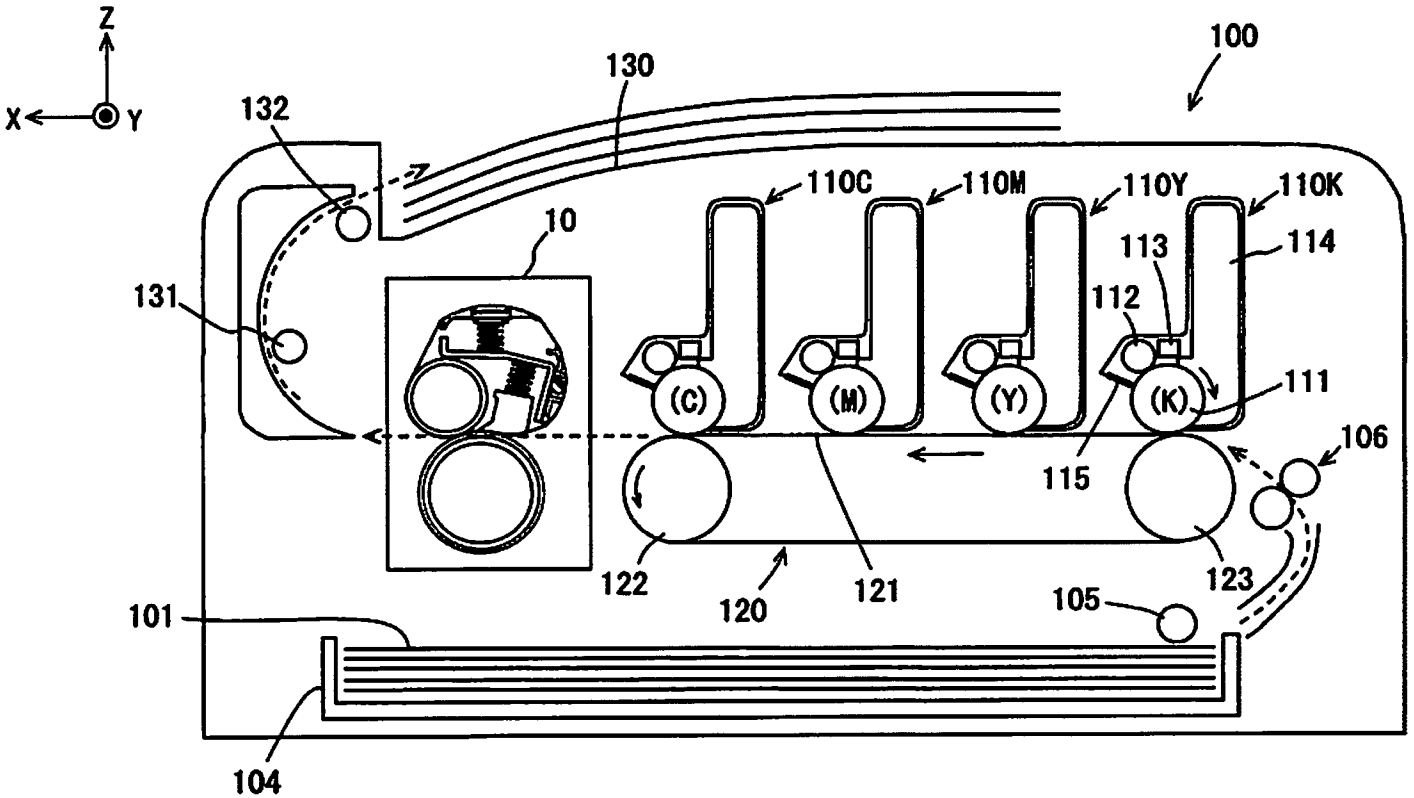
FIG. 1 is a schematic configuration view schematically illustrating a principal part configuration of an image formation apparatus according to a first embodiment which employs a fixation apparatus according to the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a schematic configuration view schematically illustrating the configuration of a principal part of an image formation apparatus according to a first embodiment which employs a fixation apparatus according to the invention.

Image formation apparatus 100 illustrated in FIG. 1 is provided with a configuration as a color electrophotographic printer, for example. Disposed inside the apparatus are: paper feed cassette 104 which houses recording paper sheets 101 as the recording media, paper feed roller 105 which takes out recording paper sheet 101 from paper feed cassette 104, and resist rollers 106 which feed recording paper sheet 101 to an image formation unit at a predetermined timing. Moreover, image formation apparatus 100 includes, as image formation units, development device 110K which forms an image of toner as a black (K) developer, development device 110Y which forms a toner image of yellow (Y), development device 110M which forms a toner image of magenta (M), and development device 110C which forms a toner image of cyan (C) (these development devices may be simply referred to as 110 if not specially required to be distinguished). The development devices are sequentially disposed from the upstream side along the conveyance path of recording paper sheets 101. Development devices 110 have the same configuration except for using toners of predetermined different colors.

For example, as illustrated in development device 110K which uses a black (K) toner, each of development devices 110 includes photoconductive drum 111 as an electrostatic latent image carrier, charge device 112, exposure device 113, developer supply device 114, cleaning device 115, and the like. Charge device 112, exposure device 113, and developer supply device 114 are disposed around photoconductive drum 111 sequentially from the upstream side in the rotation direction (arrow direction). Charge device 112 supplies electric charges to the surface of photoconductive drum 111 to charge the surface. Exposure device 113 selectively emits light on the charged surface of photoconductive drum 111 on the basis of image data to form an electrostatic latent image. Developer supply device 114 develops the electrostatic latent image formed on photoconductive drum 111 by the toner to form an image. Cleaning device 115 is disposed in contact with photoconductive drum 111 in such a manner to remove the toner remaining on the surface of photoconductive drum 111.

Moreover, image formation apparatus 100 includes a belt type transfer device 120. Transfer device 120 includes endless transfer belt 121 which conveys recording paper sheet 101, and successively transfers toner images formed in the respective development devices on the recording paper sheet 101 being conveyed. The transfer device also includes drive roller 122 which is driven to be rotated by a drive unit, which is not illustrated, to drive endless transfer belt 121 in an arrow direction, and tension roller 123 which is paired with drive roller 122 to stretch endless transfer belt 121 around them.

Further, other items disposed in transfer device 120 are: fixation apparatus 10 which fixes the toner image formed on recording paper sheet 101 by applying heat and pressure thereto, conveyance rollers 131 and 132 which convey recording paper sheet 101 being passed through fixation apparatus 10, and discharge recording paper sheet 101 conveyed to discharge paper placement unit 130 which stores recording paper sheet 101 to which the image is fixed. Fixation apparatus 10 is described in detail later.

Note that the X, Y, and Z axes in FIG. 1 are explained as follows: the X axis is a conveyance direction of recording paper sheet 101 when being passed through the image formation unit; the Y axis is a rotation shaft direction of photoconductive drum 111; and the Z axis is a direction orthogonal to both of the X axis and the Y axis. Moreover, when the respective X, Y, and Z axes are illustrated in other drawings, which are described later, these axes directions indicate the directions common in the drawings. In other words, the respective X, Y, and Z axes in each drawing indicate directions where a portion depicted in each drawing is disposed as a component constituting image formation apparatus 100 illustrated in FIG. 1. Herein, the portions are disposed in such a manner that the Z axis becomes an approximate vertical direction.

With the above configuration, an outline of a printing operation by the image formation apparatus is described with reference to FIG. 1. Note that, a dashed line arrow in the drawing indicates the conveyance direction of recording paper sheet 101 to be conveyed.

When image formation apparatus 100 is turned on, and an operator performs a well-known operation to start image formation, paper feed roller 105 takes out from paper feed cassette 104 recording paper sheet 101 housed in paper feed cassette 104 and resist rollers 106 corrects a skew thereof. Thereafter, recording paper sheet 101 thus corrected is conveyed at a predetermined timing to the image formation unit that includes four development devices 110, and transfer device 120.

In this case, with the rotation of photoconductive drums 111 in the arrow direction, each charge device 112 to which a voltage is applied by a power supply device, which is not illustrated, charges the surface of each photoconductive drum 111 of each development device 110. Subsequently, each exposure device 113 exposes the charged surface of each photoconductive drum 111 reaching the vicinity of exposure device 113, so that an electrostatic latent image in accordance with the image information is formed on the surface of photoconductive drum 111. Each developer supply device 114 develops the electrostatic latent image, so that a toner image corresponding to each color is formed on the surface of each photoconductive drum 111.

Recording paper sheet 101 conveyed to the image formation unit adheres to endless transfer belt 121 and is conveyed in an arrow direction. As recording paper sheet 101 is successively sandwiched between photoconductive drums 111 of respective development devices 110 which rotate in the arrow direction and endless transfer belt 121, toner images of the respective colors of black (K), yellow (Y), magenta (M), and cyan (C) are formed at predetermined timings. The toner images are successively transferred by being overlapped with one another on recording paper sheet 101. A color toner image (that is, a multicolor toner image) is thereby formed on recording paper sheet 101. Cleaning device 115 scrapes off any residual toner remaining on photoconductive drum 111 and cleans photoconductive drum 111 after the transferring. Photoconductive drum 111 is then used for the next charging.

Subsequently, recording paper sheet 101 with the color toner image thereon is conveyed to fixation apparatus 10. Fixation apparatus 10 pressurizes and heats the toner image on recording paper sheet 101 to be fused, and the color toner image thus fused is fixed on recording paper sheet 101. In addition, conveyance rollers 131 and 132 discharge recording paper sheet 101 to discharge paper placement unit 130, and the printing operation is completed.

Figure 2:
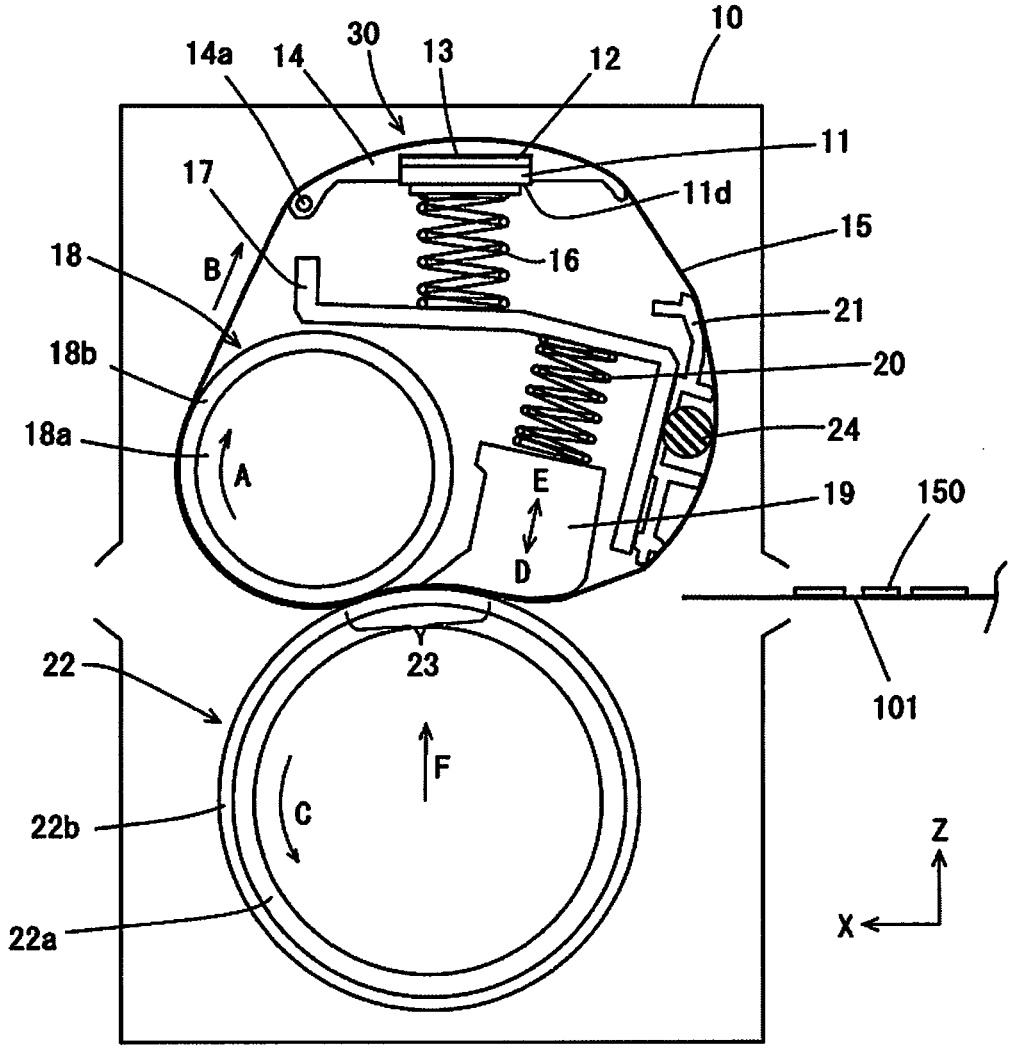
FIG. 2 is a configuration view of a principal part of the fixation apparatus according to the invention.

FIG. 2 is a configuration view of a principal part of fixation apparatus 10 according to the invention.

As illustrated in FIG. 2, fixation apparatus 10 performs a fixation such that recording paper sheet 101, on which toner image 150 is transferred, is conveyed in and passed through nip region 23 formed by endless-shaped fixation belt 15, pressurization roller 22, and the like. To this end, disposed inside fixation belt 15 are fixation roller 18, support member 17, heat unit 30, belt guide 21, press guide member 19, pressurization springs 16 and 20, and temperature sensor 24.

Fixation roller 18 includes roller-shaped core metal part **18*a* and elastic layer 18*b* disposed on an outer circumferential surface of core metal part 18*a*. Both end portions in the longitudinal direction of core metal part 18*a* with a rotation shaft thereof disposed in a Y-axis direction (longitudinal direction) are rotatably supported by rotation shaft bearings, which are not illustrated, provided in a main body of fixation apparatus 10. Fixation roller 18 is equipped with a drive system, which is not illustrated, mounted on one end portion of core metal part 18*a*. With application of power from a drive source, not illustrated, fixation roller 18 rotates in arrow A direction and transports fixation belt 15 in arrow B direction while fixation belt 15 is stretched with the inner wall face thereof being in contact with the outer circumferential surface of fixation roller 18**.

Heat unit 30 includes heat transmission member 14. Heat transmission member includes: a curved guide surface formed in an arc cross-sectional shape and guides fixation belt 15 by being in contact with the inner wall face thereof over the approximate entire area in the width direction; and pivot shaft **14*a* extended in the Y-axis direction and including both end portions turnably held by the main body of fixation apparatus 10. Heat unit 30 also includes heater member 12 disposed in contact with a flat surface portion of heat transmission member 14 with heat transmission grease 13 interposed in-between. The flat surface portion is on the opposite side of the curved guide surface. Heat unit 30 further includes pressurization plate 11 which pressurizes heater member 12** by being in contact therewith; and the like.

Figure 3:
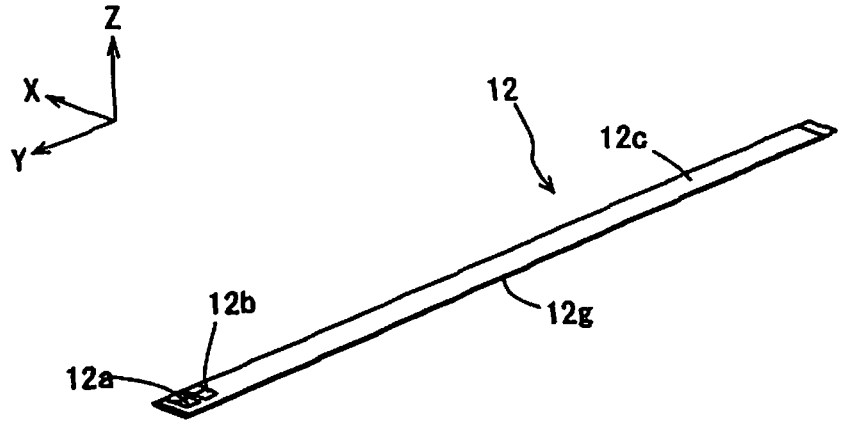
FIG. 3 is an appearance perspective view of a heater member.
Figure 4:
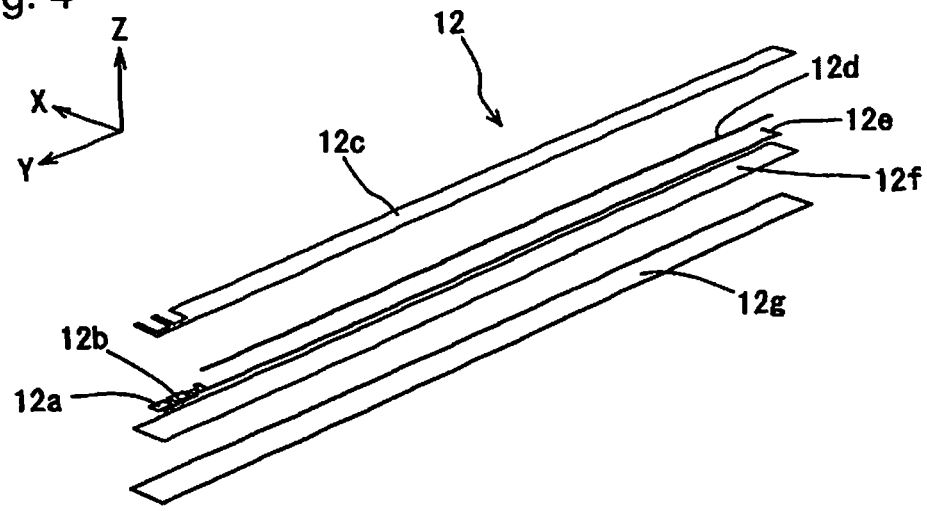
FIG. 4 is an exploded perspective view of the heater member.

FIG. 3 is an appearance perspective view of heater member 12, and FIG. 4 is an exploded perspective view thereof. As illustrated in these drawings, heater member 12 is formed with resistance line **12*d* disposed on plan-shaped base material 12*g* in such a manner that the longitudinal direction thereof is along the Y-axis direction. Resistance line 12*d* is a resistance heating element which generates heat by a current flowing therethrough. Protective layers 12*c* and 12*f* are disposed above and below resistance line 12*d*, and prevent the current flowing through resistance line 12***d* from being leaked to base material 12*g* or other members. Further, resistance line 12*d* is electrically connected to contact parts 12*a* and 12*b* by wiring 12*e*, and a current is supplied thereto via contact parts 12*a* and 12*b* from an external control apparatus, which is not illustrated.

Heat transmission grease 13 is applied between heater member 12 and heat transmission member 14 to fill a minute gap present in a junction part between heater member 12 and heat transmission member 14. The heat transmission grease functions to increase the heat transmission efficiency of both members.

Figure 5:
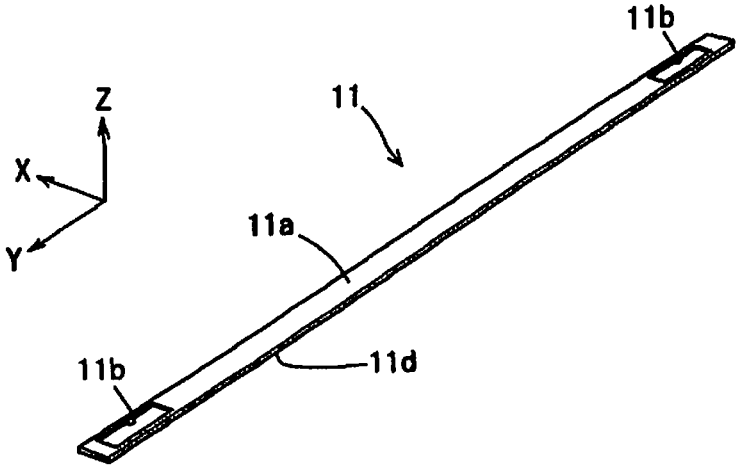
FIG. 5 is an appearance perspective view of a pressurization plate according to a first embodiment of the invention.

FIG. 5 is an appearance perspective view of pressurization plate 11 according to a first embodiment of the invention. As illustrated in the drawing, pressurization plate 11 is a sheet metal member made by press working and including temperature adjustment parts 11*b* on both end portions in the longitudinal direction thereof (Y-axis direction). Here, temperature adjustment parts 11*b* are formed in shapes recessed from heater member contact surface 11*a*. Moreover, pressurization spring 16, which is described later, presses pressurization surface 11*d* located on the opposite side of heater member contact surface 11*a*.

As illustrated in FIG. 2, support member 17 is inside fixation belt 15. Support member 17 is formed with a cross-section in an approximate L-character shape in such a manner to separate an inner part into upper and lower parts. The support member is disposed to be fixed to the main body of fixation apparatus 10. Pressurization spring 16 is suspended in a compressed state between support member 17 and pressurization surface 11*d* of pressurization plate 11 in heat unit 30. Accordingly, heater member 12 and the flat surface portion of heat transmission member 14 are in pressure contact with each other by pressurization plate 11, and the curved guide surface of heat transmission member 14. The heat transmission member is movable about pivot shaft 14*a* as the movement center is in pressure contact with the inner side of fixation belt 15. Thereby, fixation belt 15 is stretched with other members which are described later. Note that, pressurization plate 11 and pressurization spring 16 correspond to a pressurization member.

Belt guide 21 is fixed to support member 17, and abuts on fixation belt 15 on four positions from the inner side thereof to guide fixation belt 15 to have an approximately arc shape. Belt guide 21 holds temperature sensor 24 which detects the temperature of fixation belt 15 by being abutted on or close to fixation belt 15 from the inner side on an approximate center portion in this guide region. Temperature sensor 24 sends temperature information on fixation belt 15 to a controller, which is not illustrated, to allow fixation apparatus 10 to perform an excellent fixation at all times.

Pressurization roller 22 includes roller-shaped core metal part 22*a* and elastic layer 22*b* disposed on an outer circumferential surface thereof. Both end portions in the longitudinal direction of core metal part 22*a*, with a rotation shaft thereof disposed in the Y-axis direction (longitudinal direction), are rotatably supported by rotation shaft bearings, which are not illustrated, provided in the main body of fixation apparatus 10. Pressurization roller 22 is energized, by an unillustrated pressurization mechanism, toward the arrow F direction (Z-axis plus direction), that is, the direction toward fixation roller 18 and press guide member 19.

Press guide member 19 is adjacent to fixation roller 18 and is held by the main body of fixation apparatus 10, slidable in the arrow D, E directions to and from which pressurization roller 22 can be connected and separated. Press guide member 19 is energized in the arrow D direction by pressurization spring 20 which is suspended in a compressed state between press guide member 19 and support member 17 to press fixation belt 15, separated from fixation roller 18, from the inner side thereof. Press guide member 19 presses fixation belt 15 from the inner side thereof in such a manner that includes a part of the press surface on the side of fixation roller 18 and has a shape along the circumferential surface of pressurization roller 22, as illustrated in FIG. 2. Note that, press guide member 19 and pressurization spring 20 correspond to a press guide unit.

Therefore, a part of elastic layer 22*b* of pressurization roller 22 is in pressure contact with parts of elastic layer 18*b* of fixation roller 18 and the press surface of press guide member 19 with fixation belt 15 interposed in between. In this manner, these parts form nip region 23.

Fixation belt 15 includes a base material made of polyimide in an inner surface, an elastic layer made of silicone rubber and serving as an outer circumference layer of this base material, and a PFA tube serving as a surface layer. Fixation belt 15 is driven and rotated in the arrow B direction with the position thereof in the longitudinal direction (Y-axis direction) regulated by a flange member, which is not illustrated, while being stretched by fixation roller 18, heat unit 30, belt guide 21, and press guide member 19 as described above. Pressurization roller 22 rotates in the arrow C direction with the movement being in the arrow B direction of fixation belt 15. Note that, the longitudinal direction of fixation belt 15 herein indicates the same direction as the rotation shaft direction of fixation roller 18 which drives fixation belt 15.

With the above configuration, a fixation operation by fixation apparatus 10 is further described with reference to FIG. 2.

Heater member 12 of fixation apparatus 10 generates heat such that a current supplied from the control apparatus, which is not illustrated, flows through resistance line 12*d* (FIG. 4) in order to supply a sufficient amount of heat for fixing, by heat and pressure, toner image 150 formed on recording paper sheet 101 at the fixation. Fixation roller 18 of fixation apparatus 10 starts a rotation in the arrow A direction upon receiving power from a drive system, which is not illustrated, simultaneously with the generation of heat by heater member 12. With this rotation, fixation belt 15 starts to move in the arrow B direction and pressurization roller 22 starts to rotate in the arrow C direction.

Heater member 12 mounted to fixation apparatus 10 herein generates heat by resistance line 12*d* (FIG. 4) having no temperature gradient in the longitudinal direction and a uniform cross-section area. A general fixation apparatus which uses such heater member 12 includes support members for the respective members which constitute a nip on both end portions in the longitudinal direction because of the configuration of the apparatus. Heat generated by heater member 12 is transmitted to these support members on both end portions. Therefore, the temperature at both end portions tends to be lowered.

Figure 8:
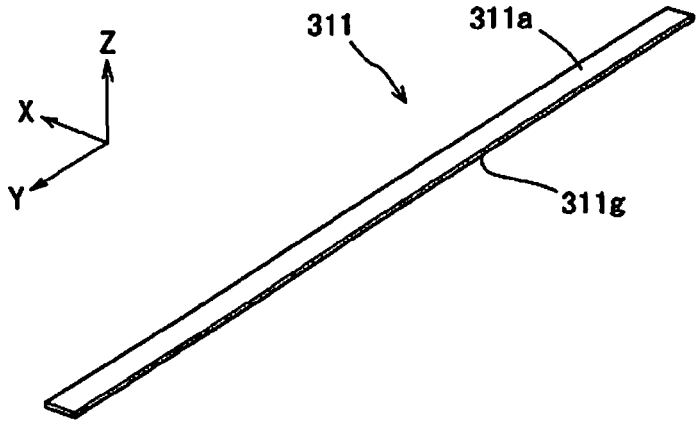
FIG. 8 is an appearance perspective view of a pressurization plate as a comparative example.

Here, as a comparative example, the manner of heat transmission in fixation apparatus 310 is described with reference to FIG. 9, and fixation apparatus 310 employing pressurization plate 311 provided with no temperature adjustment part 11*b*, as illustrated in FIG. 8, instead of employing pressurization plate 11 provided with temperature adjustment parts 11*b*, illustrated in FIG. 5, according to the invention. Note that, fixation apparatus 310 in this comparative example is fixation apparatus 10 according to the embodiment of the present application of FIG. 2 which employs pressurization plate 311 illustrated in FIG. 8, instead of employing pressurization plate 11 illustrated in FIG. 5.

Figure 9:
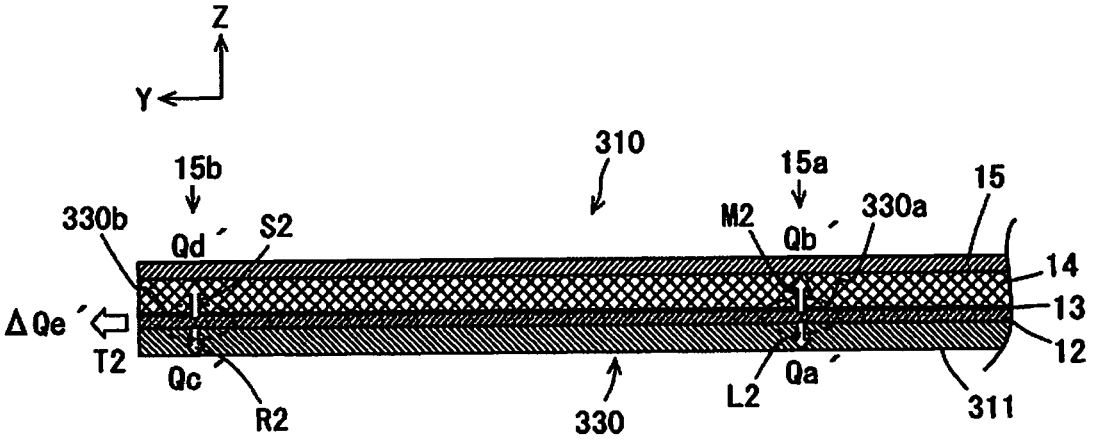
FIG. 9 is a partial cross-sectional view of a fixation apparatus of the comparative example in the vicinity of a heat unit in the longitudinal direction (Y-axis direction), and is used for explaining the way heat is transmitted in the area surrounding the heater member on both end portions and a center portion in the longitudinal direction.

FIG. 9 is a partial cross-sectional view of fixation apparatus 310 as the comparative example in the vicinity of heat unit 330 in the longitudinal direction (Y-axis direction). FIG. 9 illustrates the manner of heat transmission in the area surrounding heater member 12 on both end portions and a center portion in the longitudinal direction.

In center portion 330*a* in the longitudinal direction of heat unit 330, there are route L2 through which heat generated by heater member 12 is transmitted to pressurization plate 311, and route M2 through which the heat is transmitted to fixation belt 15 via heat transmission grease 13 and heat transmission member 14. When the amount of heat transmitted to fixation belt 15 through route M2 is set as Qb' and the amount of heat transmitted to pressurization plate 311 through route L2 is set as Qa', the temperature on center portion 15*a* in the longitudinal direction of fixation belt 15 is determined by the amount of heat Qb' transmitted through route M2.

In the surrounding area of each of both end portions 330*b* of heat unit 330, there are route R2 through which the heat is transmitted to pressurization plate 311, route S2 through which the heat is transmitted to fixation belt 15 via heat transmission grease 13 and heat transmission member 14, and route T2 through which the heat is transmitted to members supporting each of both end portions. When the amount of heat transmitted through route S2 is set as Qd', the amount of heat transmitted through route R2 is set as Qc', and the amount of heat transmitted through route T2 is set as ΔQe', the temperature at both end portions 15*b* in the longitudinal direction of fixation belt 15 is determined by the amount of heat Qd' transmitted through route S2.

Because heater member 12 herein generates a uniform amount of heat with respect to the longitudinal direction, when the amounts of generated heat in center portion 330*a* and both end portions 330*b* are equivalent, an extra amount of heat is flew out on both end portions 330*b* by the amount of heat ΔQe'. Therefore, with the outflow of the excessive amount of heat, the amount of heat Qd' transmitted to both end portions 15*b* of fixation belt 15 decreases, resulting in the lower temperature at both end portions 15*b* in the longitudinal direction of fixation belt 15 compared with that at center portion 15*a* of fixation belt 15.

Next, the manner of heat transmission of fixation apparatus 10 according to the invention provided with pressurization plate 11, including temperature adjustment parts 11*b* as illustrated in FIG. 5, is described with reference to FIG. 6.

Figure 6:
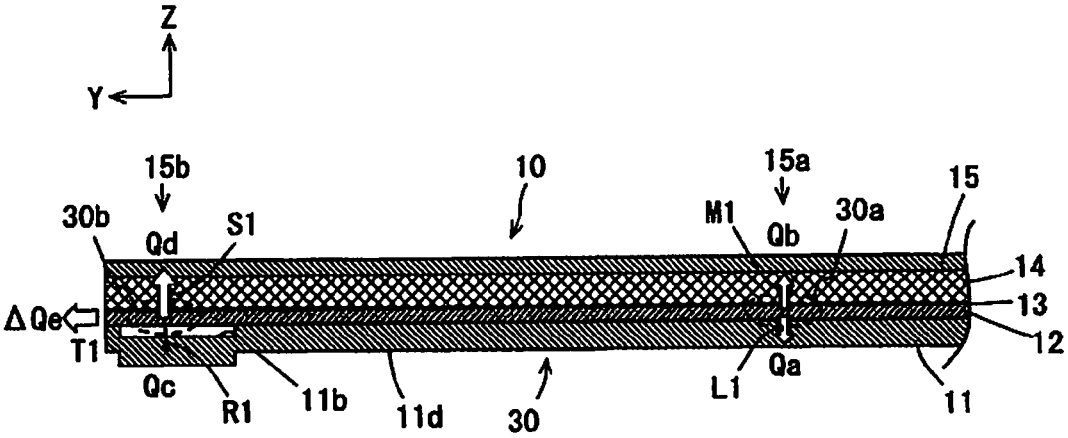
FIG. 6 is a partial cross-sectional view of a fixation apparatus according to the first embodiment of the invention in the vicinity of the heat unit in the longitudinal direction (Y-axis direction), and is used for explaining the way heat is transmitted in the area surrounding the heater member on both end portions and a center portion in the longitudinal direction.

FIG. 6 is a partial cross-sectional view of a fixation apparatus according to the first embodiment of the invention in the vicinity of heat unit 30 in the longitudinal direction (Y-axis direction). FIG. 12 is used to explain the manner of heat transmission in the surrounding area of heater member 12 on both end portions and a center portion in the longitudinal direction.

In center portion 30*a* in the longitudinal direction of heat unit 30, there are route L1 through which heat generated by heater member 12 is transmitted to pressurization plate 11, and route M1 through which the heat is transmitted to fixation belt 15 via heat transmission grease 13 and heat transmission member 14. When the amount of heat transmitted through to fixation belt 15 is set as Qb, and the amount of heat transmitted through to pressurization plate 11 is set as Qa, the temperature on center portion 15*a* in the longitudinal direction of fixation belt 15 is determined by the amount of heat Qb transmitted through route M1.

In the surrounding area of each of both end portions 30*b* of heat unit 30, there are route R1 through which the heat is transmitted to temperature adjustment part 11*b* of pressurization plate 11, route S1 through which the heat is transmitted to fixation belt 15 via heat transmission grease 13 and heat transmission member 14, and route T1 through which the heat is transmitted to members supporting each of both end portions. When the amount of heat transmitted through route M1 is set as Qb, the amount of heat transmitted through route L1 is set as Qa, the amount of heat transmitted through route S1 is set as Qd, the amount of heat transmitted through route R1 is set as Qc, and the amount of heat transmitted through route T1 is set as ΔQe, the temperature at both end portions 15*b* in the longitudinal direction of fixation belt 15 is determined by the amount of heat Qd transmitted through route S1.

Because heater member 12 generates the uniform amount of heat with respect to the longitudinal direction (Y-axis direction), when the amount of heat is Q, the relation of the amounts of heat between the center portion in the longitudinal direction and both end portions is represented by the following equation.

At the center portion in the longitudinal direction:

$$Q=Qa+Qb$$

At both end portions in the longitudinal direction:

$$Q=Qc+Qd+\Delta Qe$$

Note that, although, in FIG. 3 and FIG. 4 which illustrate the configuration of heater member 12, resistance line 12*d* is seen not to be uniformly wired to the end portions, this is for convenience. Resistance line 12*d* is actually wired to both end portions which are opposed to temperature adjustment parts 11*b* of pressurization plate 11 in such a manner to generate the uniform amount of heat.

At both end portions 30*b* in the longitudinal direction, the heat transmission efficiency from heater member 12 to pressurization plate 11 in the area surrounding recessed temperature adjustment parts 11*b* is significantly lower because of the presence of the 0*a* gap between the member and plate than that of longitudinal center portion 30*a* where the member and plate are in contact with each other. Accordingly, as for the amount of heat transmitted to pressurization plate 11 from heater member 12, the amount of heat Qc transmitted on both end portions 30*b* is smaller than the amount of heat Qa transmitted on center portion 30*a*. The amounts of heat Qd and ΔQe increase on both end portions 30*b* by a difference between the amount of heat Qa and the amount of heat Qc.

As described above, with fixation apparatus 10 according to the embodiment, compared with fixation apparatus 310 as the comparative example described above, the amount of heat Qd transmitted to both end portions 15*b* of fixation belt 15 increases to prevent the temperature at both end portions 15*b* of the belt from lowering and to keep the temperature at a desired level, thereby realizing a good state of temperature distribution in the longitudinal direction.

In addition, because pressurization plate 11 provided with temperature adjustment parts 11*b* does not come into direct-contact with fixation belt 15 which fixes a developer image, the temperature gradient generated in temperature adjustment parts 11*b* is not likely to be transferred to fixation belt 15. This results in a stable temperature distribution of fixation belt 15 in the surroundings of temperature adjustment parts 11*b*.

As described above, fixation belt 15 is heated in a good state of temperature distribution in the whole region in the longitudinal direction during when being conveyed in the arrow B direction and passing through heat unit 30, as illustrated in FIG. 2, and then is conveyed to nip region 23. In nip region 23, fixation belt 15 fixes toner image 150 formed on recording paper sheet 101 which passes through nip region 23 by heat and pressure.

Note that, in order to obtain gaps which lower the heat transmission efficiency to pressurization plate 11, recessed temperature adjustment parts 11*b* are provided in both end portions 30*b* in the longitudinal direction of pressurization plate 11 instead of heater member 12. The reason thereof is as follows. Firstly, with heater member 12 being of a non-symmetrical shape, a balance with respect to heat expansion is lost to increase thermal deformation, thereby lowering the transmission property of heat. Secondarily, because patterns such as resistance line 12*d* and wiring 12*e* are made by screen printing in heater member 12, it is difficult to form recesses and projections.

Moreover, as illustrated in FIG. 6, the thickness of recessed temperature adjustment parts 11*b* on pressurization plate 11 is formed to be approximately identical with the thickness of other portions of pressurization plate 11. The reason thereof is as follows. In other words, the thickness of pressurization plate 11 in the recessed temperature adjustment part (the thickness of pressurization plate 11 in the longitudinal direction end portions) is made to be similar to the thickness of other portions of pressurization plate 11 (the thickness of pressurization plate 11 in the longitudinal center portion) to keep the same heat capacity in the longitudinal direction end portions and the longitudinal center portion of pressurization plate 11. Accordingly, the temperature at the end portions rises with a short time interval at start-up because the end portions of pressurization plate 11 do not come into contact with heater member 12. Meanwhile, in a steady state after a long period of time is elapsed, the same heat capacity in the longitudinal direction of pressurization plate 11 prevents an excessive temperature rise at the end portions of pressurization plate 11 and thereby achieves excellent fixation. If the heat capacity at the end portion is smaller than the other portion of pressurization plate 11, such an excessive temperature rise at the end portions is likely to occur at the continuous printing for a long period of time, which may result in a fixation failure, because heat is not taken by the recording paper in the endmost portions where no recording paper is traveling.

Note that, a method of forming temperature adjustment part 11*b* by embossing is employed as a method of manufacturing recessed temperature adjustment part 11*b*, instead of a method of forming temperature adjustment part 11*b* as a through hole formed on a part of a flat member.

Here, a specific configuration example of fixation apparatus 10 is described. Pressurization plate 11 illustrated in FIG. 5 and FIG. 6 has a length of 350 [mm], a width of 10 [mm], and a thickness of 2.0 [mm], and is made of A5052. Temperature adjustment parts 11*b* each having a width of 6.5 [mm], a length of 30 [mm], and a depth of 0.5 [mm] are formed on positions apart by 120 [mm] from the center of longitudinal center portion 30*a* to both end sides, toward the respective end portion directions.

Heater member 12 illustrated in FIG. 3 and FIG. 4 includes base material 12*g* having a length of 350 [mm], a width of 10 [mm], and a thickness of 0.6 [mm] and is made of SUS. Protective layer 12*f* is made of glass, resistance line 12*d* is made of silver and a palladium alloy and has a line width of 3 [mm], and protective layer 12*c* is made of glass. These components are laminated in this order form the bottom. The output power of resistance line 12*d* herein is 1200 [W]. Heat transmission grease 13 illustrated in FIG. 2 and FIG. 6 has an improved heat transmission property by mixing powders of zinc oxide into a silicone oil.

Heat transmission member 14 illustrated in FIG. 2 and FIG. 6 is made of a material of A6063 which is an aluminum extruded material, and includes the curved surface which is brought into pressure contact with fixation belt 15 having a curvature radius R of 25 [mm] and a length of 30 [mm] relative to the conveyance direction of fixation belt 15, in the curved surface.

Fixation belt 15 illustrated in FIG. 2 and FIG. 6 has an inner diameter of ϕ45 [mm] and a width in the Y-axis direction (longitudinal direction) of 320 [mm], and includes a base material layer, an elastic layer formed on an outer circumference of the base material layer, and a PFA tube layer formed on an outer circumference of the elastic layer. The base material layer is made of polyimide and has a thickness of 0.1 [mm] in an inner surface thereof. The elastic layer is made of silicone rubber and has a thickness of 0.2 [mm]. Pressurization spring 16 illustrated in FIG. 2 herein pressurizes evenly pressurization plate 11 in the Z-axis plus direction by the pressurization force of the total 4 [kgF].

Fixation roller 18 illustrated in FIG. 2 has an outer diameter of ϕ25 [mm], and includes elastic layer 18*b* made of a silicone sponge and having a thickness of 2 [mm]. Press guide member 19 illustrated in FIG. 2 is made of an aluminum extruded material A6063 of a raw material, and includes an elastic layer made of a silicone rubber and having a thickness of about 1 [mm], in a contact surface thereof with fixation belt 15. Press guide member 19 is applied with the pressurization force of 3.5 [kgf] by pressurization spring 20 in the direction to pressurization roller 22.

Pressurization roller 22 illustrated in FIG. 2 has an outer diameter of ϕ35 [mm], and is configured to include elastic layer 22*b* formed of a silicone rubber and having a thickness of 2 [mm], and a PFA tube layer formed on the outer circumference thereof. Moreover, both ends of core metal part 22*a* in pressurization roller 22 are applied with the pressurization force of 20 [kgf] by a biasing unit, which is not illustrated, toward the arrow F direction (Z-axis plus direction), that is, the direction toward fixation roller 18 and press guide member 19.

By using fixation apparatus 10 of the abovementioned configuration example, evaluation tests are performed for measuring a difference between the temperature at the center portion and the temperature at the end portions of fixation belt 15, and the fixation rate at the end portions. For comparison, an evaluation test of fixation apparatus 310 of the comparative example which employs pressurization plate 311 provided with no temperature adjustment part 11*b* as illustrated in FIG. 8 is similarly performed. Fixation apparatus 310 of the comparative example has the same configuration as fixation apparatus 10 except for the pressurization plate.

The measurement condition of the evaluation test is as follows. (1) Thermistors are attached to the center portion and the end portions, spaced apart by 150 mm from the center portion in the longitudinal direction (Y-axis direction) of fixation belt 15 to measure the temperatures of fixation belt 15 on both portions. (2) In a state where the entire fixation belt 15 has a temperature of 25 [° C.], a current is delivered in resistance line 12*d* of heater member 12 and simultaneously fixation roller 18 is rotationally driven to rotate fixation belt 15 and pressurization roller 22. (3) The end portion temperature when the measurement temperature at the longitudinal center portion of fixation belt 15 firstly reaches 160 [° C.] at which toner image 150 on recording paper sheet 101 can be excellently fixed, and the fixation rate of the toner image in that case when printing is performed at the printing speed of 35 (ppm) in A4 transverse feed, are respectively measured.

Next, a method of measuring the fixation rate is described. (4) Firstly, under the abovementioned measurement condition, each toner of the respective colors of cyan (C), magenta (M), yellow (Y), and black (K) is transferred on and fixed to recording paper sheet 101 at the concentration set to 100% by the image formation apparatus. Note that, the toner images of the respective colors are transferred and fixed at nine measurement positions of front end portions, center portions, and rear end portions in the conveyance direction of the recording paper corresponding to positions of the longitudinal center portion and both end portions of fixation belt 15. (5) The concentration of each toner image of the respective colors fixed on recording paper sheet 101 is measured, and a value thereof is set as Nb. (6) A certain adhesive tape is adhered on each toner image of each color from the above, and a load of 500 g is applied thereto to cause the toner image and the adhesive tape to be adhered to each other. The adhesive tape is then peeled off, and the concentration Na of each toner image of each color is again measured. (7) By using the measured concentrations Nb, Na, the fixation rate is obtained from the equation below.

$$\text{Fixation rate}=(Na/Nb)\times 100[\%]$$

Note that, the fixation rate is calculated on the basis of the concentrations Nb, Na which are measured per unit of the abovementioned nine measurement positions.

Note that, if the fixation rate is less than 70%, when a user touches the toner image after the fixation with his/her finger, a part of the toner image is peeled off from the recording paper and is adhered to the finger of the user. Accordingly, for performing excellent fixation, the fixation rate is required to be set to 70% or more. Moreover, the fixation rate at 160 [° C.] set as the temperature at the belt center portion in this evaluation is 96 to 100 [%]. The fixation rate of 96 to 100 [%] herein indicates the variation range of the fixation rate obtained in the corresponding positions (plurality) among the abovementioned nine measurement positions. The fixation rate in a table below similarly indicates the variation range.

Table 1 indicates the results of the abovementioned evaluation test.

TABLE 1

Evaluation Results of Respective Fixation Devices

| Fixation apparatus | Temperature on belt center portion | Temperature on belt end portions | Temperature difference (center portion − end portion) | Fixation rate on end portions |
|---|---|---|---|---|
| 10 | 160 [° C.] | 162 [° C.] | −2 [° C.] | 96 to 100 [%] |
| 30 | 160 [° C.] | 155 [° C.] | 5 [° C.] | 86 to 93 [%] |

According to the test result of Table 1, in fixation apparatus 310 as the comparative example, the temperature at the belt end portions of fixation belt 15 is lower by 5 [° C.] than the temperature at the center portion thereof, while in fixation apparatus 10 according to the embodiment, the temperature at the belt end portions is higher by 2 [° C.] than the temperature at the center portion, and the temperature at both end portions is increased by 7 [° C.] compared with fixation apparatus 310 of the comparative example. Accordingly, the fixation rate at the end portions in fixation apparatus 310 as the comparative example is 86 to 93 [%], while the fixation rate at the end portions is increased to 96 to 100 [%] in fixation apparatus 10. In this manner, the temperature at the end portions of fixation belt 15 is raised in fixation apparatus 10 according to the embodiment compared with fixation apparatus 310 as the comparative example. This leads to the high fixation rate at the end portions.

Table 2 indicates results of the similar evaluation test performed using fixation apparatus 10N according to the embodiment which employs resistance line 12N, instead of resistance line 12*d* illustrated in FIG. 4, in which the heat generated on both end portions is decreased by 5% with respect to heat generated on the center portion, and with fixation apparatus 310N as the comparative example. Fixation apparatus 10N and fixation apparatus 310N are the same as fixation apparatus 10 and fixation apparatus 310 other than the resistance lines.

TABLE 2

Evaluation Results of Respective Fixation Apparatus when Resistance Line 12N is mounted

| Fixation apparatus | Temperature on belt center portion | Temperature on belt end portions | Temperature difference (center portion − end portion) | Fixation rate on end portions |
|---|---|---|---|---|
| 10-N | 160 [° C.] | 154 [° C.] | 6 [° C.] | 86 to 91 [%] |
| 310-N | 160 [° C.] | 145 [° C.] | 15 [° C.] | 71 to 79 [%] |

In this case, according to the test results of Table 2, the temperature at the center portion of fixation belt 15 is 160 [° C.] in both fixation apparatus 10N and fixation apparatus 310N, and thus the fixation rate here is 96 to 100 [%] in both of the fixation apparatuses. However, in fixation apparatus 310 as the comparative example, although the fixation rate at the end portions is 71 to 79 [%], which exceeds 70 [%] as the evaluation reference of quality, the lower limit of variation is nearly 70 [%]. Therefore, the margin is very small. On the other hand, in fixation apparatus 10N according to the embodiment, the fixation rate at the end portions is 86 to 91 [%], which significantly exceeds 70 [%] as the evaluation reference. In this manner, with fixation apparatus 10N according to the embodiment, stable fixation is performed even when resistance line 12N is used in which the heat generated on both end portions is lower by 5% than the heat generated on the center portion.

As described above, with fixation apparatus 10 according to the embodiment in which pressurization plate 11 is provided with the temperature adjustment parts, it is possible to reduce the temperature uniformity in the longitudinal direction of fixation belt 15, and to perform excellent fixation in the whole directions orthogonal to the conveyance direction of the recording paper.

Second Embodiment

Figure 7:
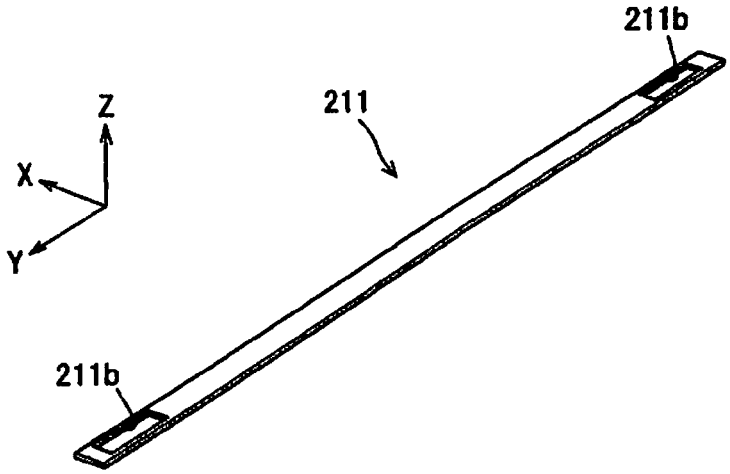
FIG. 7 is an appearance perspective view of a pressurization plate according to a second embodiment of the invention.

FIG. 7 is an appearance perspective view illustrating the configuration of pressurization plate 211 which is employed in a fixation apparatus according to a second embodiment of the invention. The fixation apparatus according to the embodiment is totally the same as fixation apparatus 10 in the first embodiment illustrated in FIG. 2 except for employing pressurization plate 211 instead of pressurization plate 11 in the abovementioned first embodiment illustrated in FIG. 5. Accordingly, the same reference numerals are assigned to the portions in the fixation apparatus common to those in fixation apparatus 10 in the abovementioned first embodiment or the drawings are omitted, and thus explanations thereof are omitted. The emphasis is put on an explanation of points that are different. Note that, the principal part configuration of the fixation apparatus according to the embodiment is common to the principal part configuration of fixation apparatus 10 in the first embodiment other than that of pressurization plate 211 illustrated in FIG. 2, and therefore FIG. 2 is referred if necessary.

As illustrated in FIG. 7, pressurization plate 211 according to the embodiment includes temperature adjustment parts 211*b*, 211*b* on both end portions in the longitudinal direction (Y-axis direction), and is a sheet metal member formed by press working and in a hole shape through which temperature adjustment parts 211*b*, 211*b* penetrate. The configuration of pressurization plate 211 other than the above is the same as that of pressurization plate 11 in the first embodiment illustrated in FIG. 5. In this case, because the heat capacity in regions of temperature adjustment parts 211*b*, 211*b* is less than that on the center portion, the amount of heat generated by heater member 12 (see FIG. 6) transmitted to pressurization plate 211 decreases on both end portions where temperature adjustment parts 211*b*, 211*b* are provided. As a result, the amount of heat transmitted to both end portions of fixation belt 15 is increased. Other operations are similar to those in the first embodiment.

The heat capacity of temperature adjustment part 211*b* in pressurization plate 211 according to the embodiment is less than that of temperature adjustment part 11*b* in pressurization plate 11 in the abovementioned first embodiment. Therefore, the heater member in which pressurization plate 211 is employed transmits the increased amount of heat to both end portions of fixation belt 15, compared with heater member 12 in the first embodiment.

As described above, with the fixation apparatus according to the embodiment, because temperature adjustment parts 211*b* each having a hole shape are provided in pressurization plate 211, it is possible to further increase the temperature control range of the fixation belt in the longitudinal direction compared with that of the fixation apparatus in the abovementioned first embodiment.

Note that, in the abovementioned respective embodiments, although press guide member 19 is used for enlarging nip region 23 (support for high-speed data printing), the invention is not limited thereto, and the configuration with no press guide member 19 is possible. Moreover, in the abovementioned respective embodiments, although heat unit 30 is disposed on a position apart from nip region 23, the invention is not limited thereto, and can be configured such that heat unit 30 energized by the pressurization spring is disposed instead of press guide member 19, and the nip region is formed simultaneously with the heating of fixation belt 15. Moreover, in the abovementioned respective embodiments, although heat unit 30 is brought into pressure contact with fixation belt 15 from the inner side thereof, the invention is not limited thereto, and can be configured such that heat unit 30 is brought into pressure contact with fixation belt 15 from the outer side thereof. Moreover, in the abovementioned respective embodiments, although pressurization roller 22 is provided for forming nip region 23, the invention is not limited thereto, and can be configured such that a slide member other than the roller is provided. In addition, in the abovementioned respective embodiments, although the driving force of the fixation apparatus is transmitted from fixation roller 18, the invention is not limited thereto, and can be configured such that the driving force thereof is transmitted from pressurization roller 22. As described above, various modifications can be made.

In the abovementioned embodiments, although the invention is explained using a fixation apparatus for a color electrophotographic printer as an example, the invention is not limited thereto, and is applicable to a fixation apparatus of an image formation apparatus including a copying machine, a facsimile, or an MFP which forms an image of a recording medium using the electrophotographic method. Further, although the explanation is made with respect to the color printer, the invention may be also applicable to a monochrome printer.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixation apparatus to fix a developer image transferred on a recording medium, the fixation apparatus comprising:

a fixation belt;

a heater member configured to generate heat by a resistance heating element and heat the fixation belt; and a pressurization member provided on a position opposed to the fixation belt with the heater member interposed in between and configured to press the heater member against the fixation belt while being in contact with the heater member, wherein the pressurization member includes a temperature adjustment part provided near an end portion in a longitudinal direction thereof and configured to suppress an amount of heat transmitted from the heater member, such that an amount of heat transferred from the heater member to the pressurization member is smaller at the end portion as compared to a center portion of the pressurization member in the longitudinal direction, wherein the temperature adjustment part of the pressurization member comprises a groove that forms a gap between the temperature adjustment part and the heater member, such that a thickness of a region of the pressurization member where the groove is provided is approximately equal to a thickness of a region of the pressurization member where the groove is not provided.

2. The fixation apparatus according to claim 1, wherein the pressurization member includes a pressurization plate configured to be in contact with the heater member and including the temperature adjustment part, and a pressurization spring configured to bias the pressurization plate toward the fixation belt.

3. The fixation apparatus according to claim 1, further comprising a heat transmission member provided between the heater member and the fixation belt and configured to transmit heat.

4. The fixation apparatus according to claim 1, wherein the fixation belt is an endless belt, and the heater member and the pressurization member are disposed inside the fixation belt.

5. The fixation apparatus according to claim 1, further comprising:

a fixation roller and a belt guide which are disposed inside the fixation belt, wherein the fixation belt is pressed to be under tension by the pressurization member with the heater member interposed in between in such a way that the fixation roller, the belt guide, and the heater member are directly or indirectly in contact with an inner circumference surface of the fixation belt.

6. The fixation apparatus according to claim 5, further comprising a pressurization roller provided outside the fixation belt and configured to be in pressure contact with the fixation roller with the fixation belt interposed between said pressurization roller and said fixation roller and to form a first nip part between the pressurization roller and the fixation roller though which the recording medium is transportable together with the fixation belt.

7. The fixation apparatus according to claim 6, further comprising a press guide unit provided inside the fixation belt and configured to be in pressure contact with the pressurization roller with the fixation belt interposed between the press guide unit and the pressurization roller and to form a second nip part between the press guide unit and the pressurization roller though which the recording medium is transportable together with the fixation belt.

8. The fixation apparatus according to claim 7, wherein the first nip part and the second nip part are directly connected to each other.

9. The fixation apparatus according to claim 1, further comprising a temperature sensor configured to detect a temperature of the fixation belt.

10. An image formation apparatus comprising the fixation apparatus according to claim 1.

11. A fixation apparatus to fix a developer image transferred on a recording medium, the fixation apparatus comprising:

a belt;

a heater member configured to heat the belt; and a press member configured to press the heater member against the belt, wherein the press member includes a press plate with a press region in contact with the heater member and non-contact regions not in contact with the heater member, wherein the non-contact regions are disposed at both ends of the press region, such that contact areas between the press member and the heater member are formed narrower at the both ends of the press region as compared to a contact area between the press member and the heater member at a center portion of the press region.

12. The fixation apparatus according to claim 11, wherein the non-contact region comprises a groove recessed from a surface of the press plate in contact with the heater member such that a thickness of a region of the pressurization member where the groove is provided is approximately equal to a thickness of a region of the pressurization member where the groove is not provided.

13. The fixation apparatus according to claim 12, wherein the non-contact region is provided outside the press region in a direction orthogonal to a traveling direction of the belt.

14. An image formation apparatus comprising the fixation apparatus according to claim 12.

15. The fixation apparatus according to claim 1, wherein the temperature adjustment part is provided only near the end portion in the longitudinal direction of the pressurization member.

* * * * *